United States Patent [19]

Zimmermann

[11] 4,151,783

[45] May 1, 1979

[54] APPARATUS FOR SHAPING A LUG ON A STAMPED WORKPIECE

[75] Inventor: Willy Zimmermann, Bitz, Fed. Rep. of Germany

[73] Assignee: Compagnie d'Informatique Militaire, Spatiale et Aeronautique, Paris, France

[21] Appl. No.: 824,334

[22] Filed: Aug. 12, 1977

[30] Foreign Application Priority Data

Aug. 18, 1976 [DE] Fed. Rep. of Germany ..... 2637078

[51] Int. Cl.[2] ..... B23C 1/18; B24B 9/04; B24B 7/04; B24B 5/16

[52] U.S. Cl. ..... 409/165; 409/190; 409/97; 51/101 R

[58] Field of Search ..... 90/14, 20, 11 R, 15 R, 90/15 A, 13.9, 13 R; 51/89, 101 R, 127, 90, 119, 354, 118, 127

[56] References Cited

U.S. PATENT DOCUMENTS

| | | | |
|---|---|---|---|
| 1,521,116 | 12/1924 | Miller | 51/89 X |
| 2,252,841 | 8/1941 | Drummond | 90/20 |
| 2,579,337 | 12/1951 | Reaser et al. | 51/101 R |
| 2,597,180 | 5/1952 | Reaser et al. | 51/101 R |
| 2,883,800 | 4/1959 | Reaser et al. | 51/101 R |
| 2,906,065 | 9/1959 | Reaser | 51/101 R |
| 3,274,736 | 9/1966 | Brokaw | 51/127 X |
| 3,948,144 | 4/1976 | Nagano | 90/20 |

*Primary Examiner*—Horace M. Culver
*Attorney, Agent, or Firm*—Karl F. Ross

[57] ABSTRACT

A flat, elongate workpiece such as a knitting-machine needle, stamped from sheet metal with a transverse lug whose narrow faces require precise machining, is clamped in a workpiece holder with its lug centered on an axis about which the workpiece holder and an associated tool mounting are relatively rotatable. The tool mounting includes two symmetrically positioned supports, carrying respective power-driven shaping tools such as grinding wheels or millers, which are limitedly movable in a plane including the axis and are interconnected by a tension spring drawing them toward each other. An interposed cam disk, engaged by rollers mounted on these supports, determines the extent to which the two shaping tools can approach the axis in machining respective lug faces during a relative rotation of up to 180°.

7 Claims, 11 Drawing Figures

APPARATUS FOR SHAPING A LUG ON A STAMPED WORKPIECE

FIELD OF THE INVENTION

My present invention relates to an apparatus for shaping opposite narrow faces of a transverse lug on a flat elongate workpiece, such as a needle or a clavette of a knitting machine, stamped from sheet metal.

BACKGROUND OF THE INVENTION

Knitting-machine needles were initially formed from round wire with bent tips serving as cam-follower lugs or butts. The smooth surface of these tips made it easy for them to slide along the camming surfaces of the needle lock. With the development of more sophisticated knitting machines, however, the shape of the needles and similar implements, e.g. clavettes, became more complex, requiring their manufacture by a stamping process from flat sheet steel. The lugs of such stamped workpieces, however, have rough edges which must be smoothed in order to facilitate their displacement within the needle bed and to assure precise coaction with associated cam grooves in which these lugs are usually held captive, opposite edges thereof being thus engaged during ascending and descending strokes.

Various ways have already been proposed in which such camming lugs or butts are to be machined after stamping for smoothing and truing purposes. According to one known process, the two narrow butt faces transverse to the principal dimension of the needle or clavette are beveled at angles of about 45°, yet this requires a succession of separate operating steps with intervening repositioning of the workpiece; such a beveling of the edges of these narrow faces, moreover, generally leaves about 40 to 50% of the original area of these faces in its prior rough condition. If that residual area is also to be machined, the number of grinding of milling operations is further increased and maintenance of the desired tolerances is exceedingly difficult; such a treatment, accordingly, is warranted only in the case of high-precision needles or the like.

Other prior proposals aim at a combined stamping and shaping operation designed to produce a desired butt profile by pressing. That technique, which is applicable only to relatively heavy workpieces, results in the formation of burrs requiring a separate trimming step for their removal.

OBJECTS OF THE INVENTION

The general object of my present invention, accordingly, is to provide an apparatus designed to machine such lugs or butts in an efficient manner on both hardened and nonhardened workpieces which may be of widely varying thickness.

A more particular object is to provide an apparatus of this description which can be conveniently adapted to a diversity of lug profiles.

SUMMARY OF THE INVENTION

I realize these objects, in accordance with my present invention, by providing a tool mounting and a workpiece holder that are relatively rotatable about an axis on which a lug to be machined is centered when the workpiece bearing that lug is clamped on the holder in a position perpendicular to the axis of rotation. A power-driven surface-working tool such as a grinding wheel or a miller is secured to a support so carried on the tool mounting as to be radially displaceable with reference to that axis; in a preferred embodiment, two such supports carrying respective power tools are symmetrically disposed on opposite sides of the axis. Upon relative rotation of the tool mounting and the workpiece holder by suitable drive means, the support or supports are controlledly displaced toward and away from the axis by guide means operatively coupled with the tool mounting and the workpiece holder, the guide means advantageously comprising a cam on the workpiece holder and a cam follower on each radially displaceable support. Although a slave cam could be used, I prefer to provide a simple cam disk peripherally engaged by spring-loaded rollers.

BRIEF DESCRIPTION OF THE DRAWING

The above and other features of my invention will now be described in detail with reference to the accompanying drawing in which.

SPECIFIC DESCRIPTION

Figure 1:
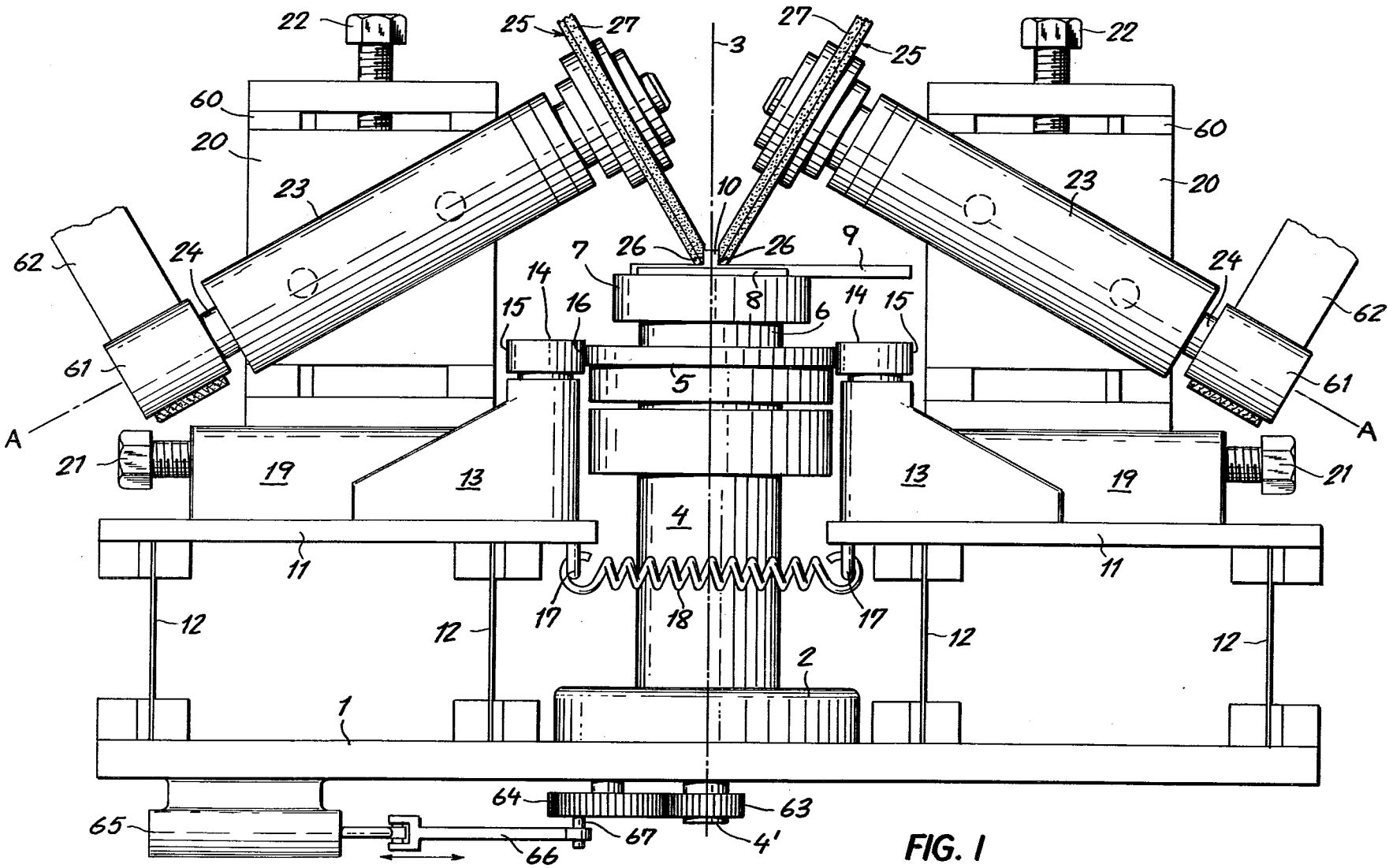
FIG. 1 is a side-elevational view of an embodiment in which a workpiece holder is rotatable about a vertical axis and co-operates with a pair of grinding wheels supported on a stationary tool mounting.

The apparatus shown in FIG. 1 comprises a base plate 1 with a bearing 2 in which a shaft 4 is journaled for rotation about a vertical axis 3. The free upper end of the shaft carries a cam disk 5 topped by a boss 6 of a workpiece holder 7 which has a pair of clamping jaws 8 (only one visible in this Figure) for immobilizing a knitting needle 9 in a diametrical plane; the needle has a transverse lug or butt 10 which rises vertically along the axis in this operating position and whose narrow faces 26 are to be symmetrically machined.

Shaft 4 is flanked by a pair of radially movable supporting plates 11 which are mounted on base plate 1 by respective pairs of resilient legs 12 in the form of leaf springs. Each plate 11 is rigid with a frame 13 carrying a roller 14 whose peripheral surface 15 is maintained in contact with the peripheral surface 16 of disk 5 by a tension spring 18 anchored to eyes 17 on plates 11.

The two assemblies 11, 13 thus constitute a pair of carriages that are drawn toward each other by the spring 18 and maintain the rollers 14 engaged with disk 5 at diametrically opposite points.

Each plate 11 further supports a slider 19 guided by the associated frame 13 for relative radial displacement with the aid of an adjusting screw 21 threaded through the slider and rotatably held in the frame. A vertical plate 20 rises above each slider 19, in the manner of a cross-slide, and is adjustable along a guide frame 60 with the aid of another setting screw 22. Each plate 20 supports a barrel 23 wherein a shaft 24 is journaled for rotation about a bearing axis A which is inclined to the horizontal, i.e. to a plane perpendicular to central axis 3. This shaft is keyed to a grinding wheel 25 with a beveled peripheral surface 27 designed to machine a corresponding face 26 of lug 10. Shaft 24 carries a pulley 61 engaged by a belt 62 through which the grinding wheel 25 can be driven at high speed from a nonillustrated motor.

A downward extension 4' of shaft 4 is shown to carry a pinion 63 meshing with a larger gear 64 which is journaled on the underside of base plate 1. An actuator 65, such as a fluid-operated jack or a solenoid, is linked via a pitman 66 with an eccentric pin 67 on gear 64 to oscillate the latter through an arc sufficient to turn the shaft 4 together with cam disk 5 and workpiece holder 7 through about 180°.

Figure 4:
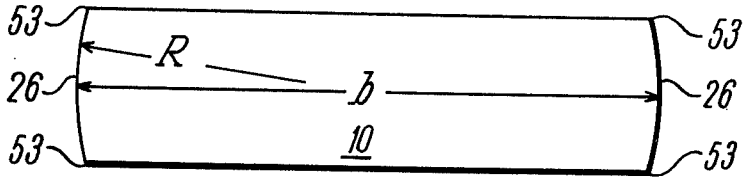
FIGS. 4–11 are diagrammatic illustrations, drawn to an enlarged scale, of a variety of lug profiles that can be machined by the apparatus of FIG. 1 or that of FIGS. 2 and 3.

At the start of an operating cycle, with shaft 4 offset by 90° from its illustrated position, cam disk 5 holds the rollers 14 sufficiently far apart to let the lug 10 move freely into and out of the gap between grinding wheels 25 upon separation of the clamping jaws 8. After the needle 9 has been clamped in position, the tool drive 61, 62 and the actuator 65 are set in operation, with the grinding wheels approaching each other to begin the machining operation as soon as the edges 53 of the lug 10 are aligned therewith (see FIG. 4). As the shaft 4 continues its rotation, the two faces 26 are ground, e.g. cylindrically with a radius R as illustrated in FIG. 4. In this particular instance, the width b of the lug is equal to 2R.

Figure 5:
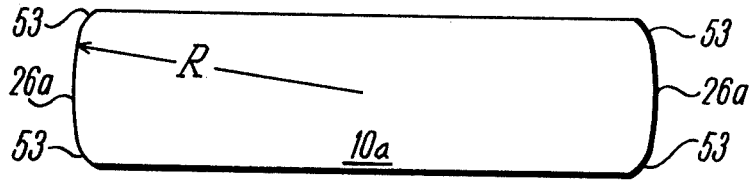
Figure 6:
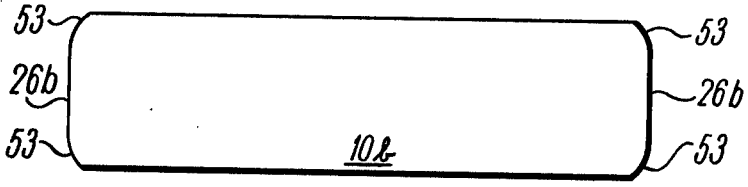
Figure 7:
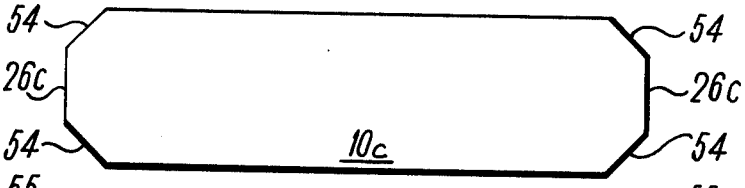
Figure 8:
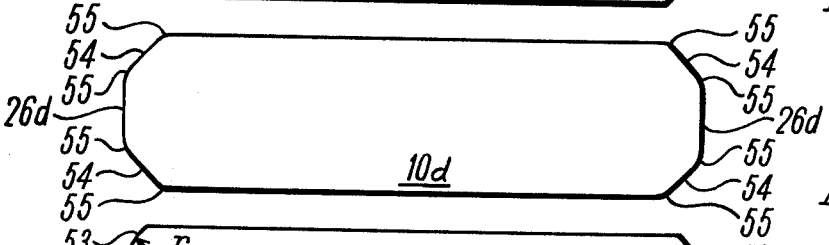
Figure 9:
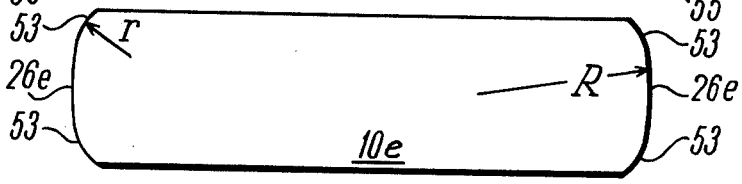
Figure 10:
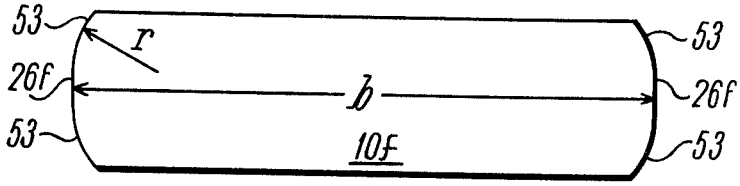
Figure 11:
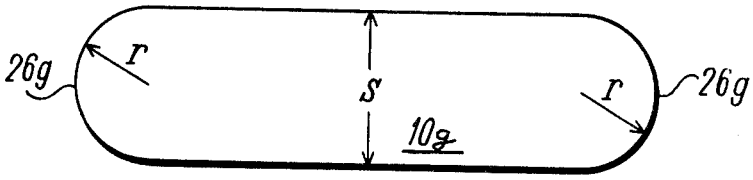

As shown in FIG. 5, a lug **10*a* may have its edges 53 curved with a shorter radius than the remainder of faces 26*a*. In FIG. 6 the faces 26*b* of a lug 10*b* are flattened. FIG. 7 shows a lug 10*c* with flattened faces 26*c* and beveled edges 54. A lug 10*d*, FIG. 8, has flat faces 26*d* and 45° bevels 54 with rounded edges 55. In FIGS. 9 and 10 I have shown lugs 10*e*, 10*f* with profiles similar to that of lug 10*a*, FIG. 5, except for different radii of curvature r of the edge portions 53 flanking the central areas 26*e*, 26*f* of their faces. FIG. 11, finally, illustrates a lug 10*g* with faces 26*g*** of cylindrical curvature having a radius r equal to half the lug thickness s.

These various profiles can all be produced by the machine of FIG. 1 with the aid of different cam disks 5.

Where only a single carriage 11, 13 and one grinding tool 23, 25 is provided, the same profiles can be formed if the shaft 4 is rotated through a full or nearly full turn instead of half a turn, the two opposite lug faces being then machined successively rather than simultaneously.

Figure 3:
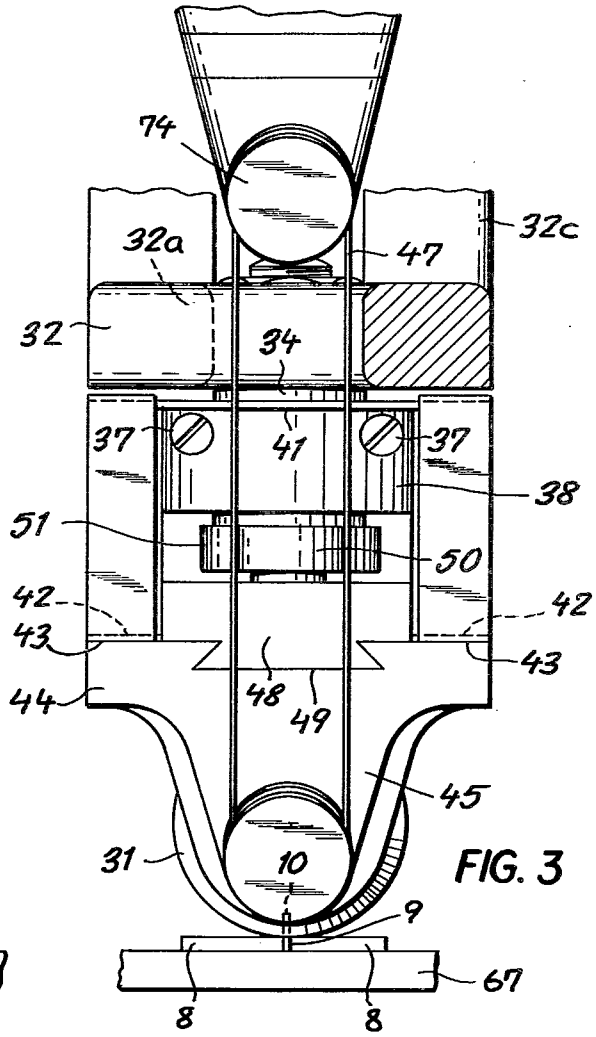
FIG. 3 is a side view as seen in the direction III of FIG. 2.
Figure 2:
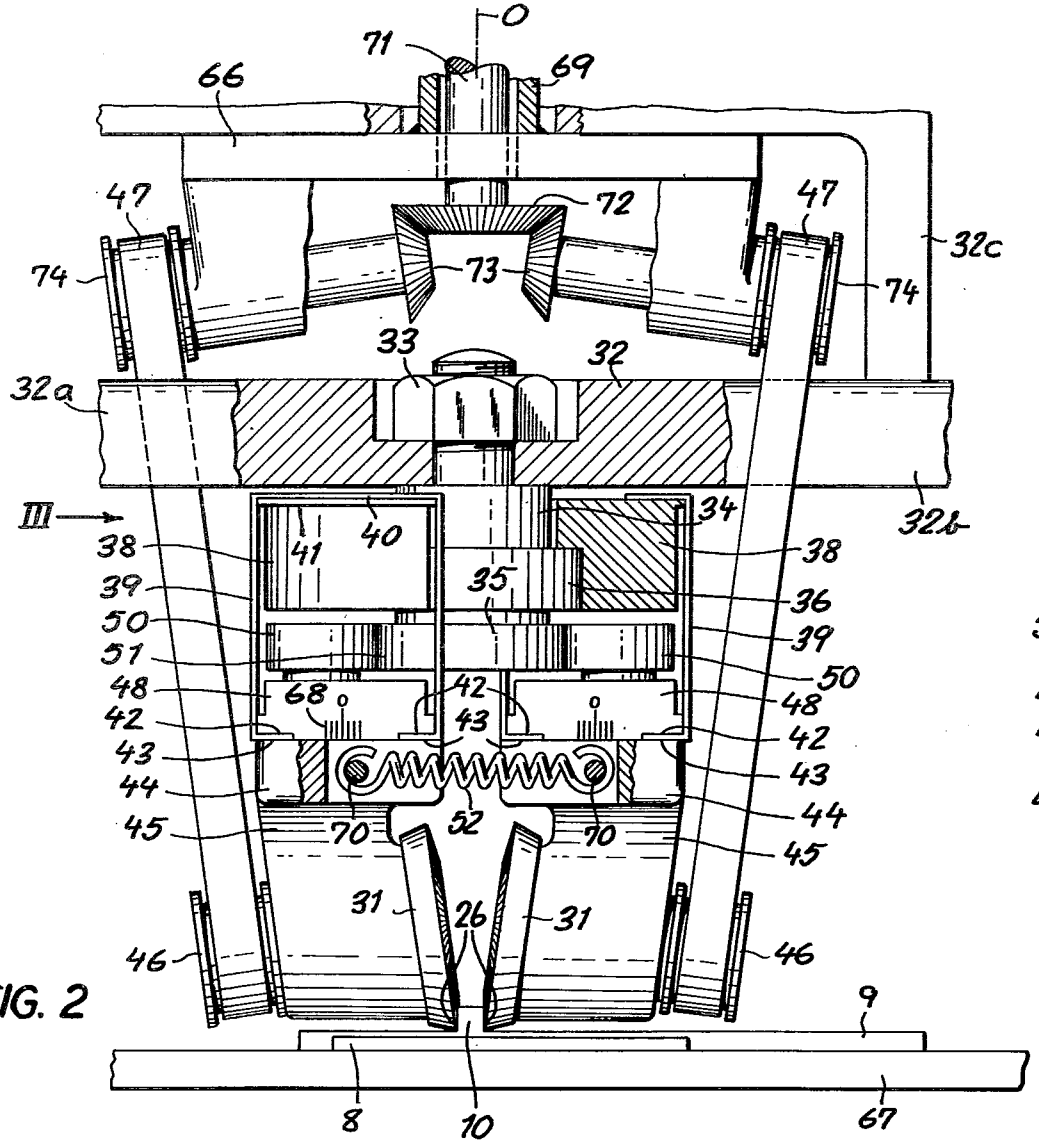
FIG. 2 is a view generally similar to FIG. 1 but with parts broken away, representing another embodiment with a stationary workpiece holder and a rotatable tool mounting.

In FIGS. 2 and 3 I have shown an apparatus representing a kinematic inversion of the system of FIG. 1, with a rotatable tool mounting and a stationary workpiece holder. The latter comprises a machine bed 67 carrying the clamp jaws 8 which, as in the preceding embodiment, close around the workpiece 9 to hold the lug thereof centered on an axis of rotation O. A beam 32, rigid with machine bed 67, carries a threaded stem 34, fastened to it by a nut 33, a shoulder 36 of which engages a pair of bearing blocks 38 held together by bolts 37. Stem 34 is rigid with a stationary cam disk 35. A pair of radially movable carriages 44 are suspended from the blocks 38 by respective pairs of leaf springs 39 which are generally U-shaped, with bight portions 40 resting on ledges 41 of these blocks and with bent-over extremities 42 received in recesses 43 of the carriages. Each carriage 44 has a radially extending dovetail groove 49 for the guidance of a respective slider 48 whose position relative to the carriage may be adjusted by means such as the screws 21 of FIG. 1; the adjustment position may be read on a respective scale 68.

The two carriages 44 are drawn toward each other by a spring 52 anchored to a pair of pins 70 within confronting central recesses of these carriages. Rollers 50, journaled on the sliders 48, are thereby held in contact with the peripheral surface 51 of cam disk 35.

Each carriage 44 has a depending boss 45 forming a journal bearing for the shaft of a respective milling tool 31 also carrying a pulley 46 engaged by a belt 47. The two belts 47 pass on opposite sides of the beam 32 which has two relatively offset sections **32*a*, 32*b* to permit the swing of each belt about central axis O through an arc of approximately 180°. An upward extension 32*c* of the beam supports a turntable 66 which is rotatable about the axis O by a tubular shaft 69 and nonillustrated drive means. A shaft 71, driven by a high-speed motor also not shown, coaxially traverses the shaft 69 as well as the turntable 66 and carries a bevel gear 72 meshing with two similar gears 73 on the shafts of a pair of pulleys 74 embraced by the belts 47. Thus, the entire assembly 38–50 can be entrained by the turntable 66 about axis O, via belts 47, in an oscillating motion independently of the rotation of the millers 31** by the same belts about bearing axes symmetrically inclined to the horizontal. If necessary, that assembly could also be linked with the turntable by additional elements of a more rigid nature.

As will be readily apparent, the system of FIGS. 2 and 3 operates in essentially the manner described above with reference to FIG. 1, cam disk 35 determining the radial separation of the tool supports 45 in any relative angular position of the rotatable assembly and the stationary workpiece 9. In a starting position, perpendicular to the one shown, the operation of the milling tools 31 is again sufficient to allow the emplacement and removal of the workpiece upon a loosening of the clamp 8. Naturally, the milling tools 31 could be replaced by the grinding wheels 25 of FIG. 1, or vice versa.

Since the system of FIGS. 2 and 3 does not require any movement of the needle 9 during the machining of its butt 10, it could be readily installed on the bed of a machine performing other operations such as the shaping of the needle tip, for example.

I claim:

1. An apparatus for shaping opposite narrow faces of a transverse lug on a flat elongate workpiece stamped from sheet metal, comprising:

a workpiece holder provided with cam means;

a tool mounting;

drive means for rotating said tool mounting and said workpiece holder relatively to each other about a central axis;

clamping means on said workpiece holder for securing a workpiece in a position perpendicular to said central axis with its lug centered on said central axis;

a pair of carriages symmetrically disposed on said tool mounting with reference to said central axis with freedom of radial displacement relative to said tool mounting;

a pair of journal bearings supported on said carriages with bearing axes symmetrically inclined to a plane which is perpendicular to said central axis;

a pair of power-driven tools rotatably journaled in said bearings for engagement with said workpiece;

a pair of cam followers on said carriages coacting with said cam means for controlledly displacing said carriages toward and away from said central axis during rotation of said workpiece holder relative to said tool mounting; and spring means interconnecting said carriages and urging same toward said central axis.

2. An apparatus as defined in claim 1 wherein said central axis is vertical.

3. An apparatus as defined in claim 2 wherein said carriages are provided with spring legs resiliently connecting same with said tool mounting.

4. An apparatus as defined in claim 1 wherein said spring means comprises a tension spring.

5. An apparatus as defined in claim 4 wherein said cam means comprises a cam perpendicular to said central axis, said cam-follower means comprising a pair of rollers contacting said cam disk at diametrically opposite locations.

6. An apparatus as defined in claim 1 wherein each of said tools comprises a grinding wheel.

7. An apparatus as defined in claim 1 each of said tools comprises a miller.

* * * * *